US005565293A

United States Patent [19]

Akiyama et al.

[11] Patent Number: 5,565,293

[45] Date of Patent: Oct. 15, 1996

[54] ENCAPSULATED TONER FOR HEAT-AND-PRESSURE FIXING

[75] Inventors: Koji Akiyama, Wakayama; Koji Kameyama, Wakayama-Ken; Koji Shimokusa; Kuniyasu Kawabe, both of Wakayama, all of Japan

[73] Assignee: KAO Corporation, Tokyo, Japan

[21] Appl. No.: 401,438

[22] Filed: Mar. 9, 1995

[30] Foreign Application Priority Data

Mar. 9, 1994 [JP] Japan ..... 6-066814

[51] Int. Cl.[6] ..... G03G 9/093

[52] U.S. Cl. ..... 430/109; 430/138

[58] Field of Search ..... 430/109, 138

[56] References Cited

U.S. PATENT DOCUMENTS

| | | | |
|---|---|---|---|
| 2,297,691 | 10/1942 | Carlson . | |
| 2,357,809 | 9/1944 | Carlson . | |
| 3,269,626 | 8/1966 | Albrecht . | |
| 5,376,490 | 12/1994 | Sasaki et al. | 430/138 |
| 5,428,438 | 6/1995 | Yasuda et al. | 430/109 |
| 5,443,936 | 8/1995 | Yasuda et al. | 430/138 |

FOREIGN PATENT DOCUMENTS

| | | |
|---|---|---|
| 0552785 | 7/1993 | European Pat. Off. . |
| 0587036 | 3/1994 | European Pat. Off. . |
| 0615167 | 9/1994 | European Pat. Off. . |
| 0616263 | 9/1994 | European Pat. Off. . |
| 48-075032 | 10/1973 | Japan . |
| 48-075033 | 10/1973 | Japan . |
| 50-044836 | 4/1975 | Japan . |
| 57-00493 | 1/1982 | Japan . |
| 57-037353 | 3/1982 | Japan . |
| 4533617 | 8/1985 | Japan . |
| 61-056352 | 3/1986 | Japan . |
| 63-128357 | 5/1988 | Japan . |
| 63-128358 | 5/1988 | Japan . |
| 63-128359 | 5/1988 | Japan . |
| 63-128360 | 5/1988 | Japan . |
| 63-128361 | 5/1988 | Japan . |
| 63-128362 | 5/1988 | Japan . |
| 63-281168 | 11/1988 | Japan . |
| 63-316134 | 6/1990 | Japan . |
| 4-184358 | 7/1992 | Japan . |

*Primary Examiner*—John Goodrow

*Attorney, Agent, or Firm*—Birch, Stewart, Kolasch & Birch, LLP

[57] ABSTRACT

The encapsulated toner for heat-and-pressure fixing of the present invention has a heat-fusible core material containing at least a thermoplastic resin and a coloring agent and a shell formed thereon so as to cover the surface of the core material. Moreover, the encapsulated toner has the following properties: 1) The glass transition temperature ascribed to the thermoplastic resin used as a main component of the heat-fusible core material is 10° C. to 50° C.; 2) A minimum load required for 58 compression of a particle size of the encapsulated toner is from 5 to 50 mgf, and a minimum load required for 10% compression of a particle size of the encapsulated toner is from 10 to 100 mgf, when a compressive variation of one toner particle is measured by a micro compression testing machine under the given conditions; and 3) The difference in cohesiveness before and after keeping the toner standing at 50° C. for 24 hours, is not more than 10, wherein the cohesiveness is defined as the sum of values (a), (b), and (c) obtained by the following equations:

(a)=(weight % of the toner remaining×1, on a 250 μm mesh-sieve)

(b)=(weight % of the toner remaining×0.6, and on a 149 μm mesh-sieve)

(c)=(weight % of the toner remaining×0.2, on a 74 μm mesh-sieve)

each of the weight % in the equations being measured by a powder property analyzer.

17 Claims, 1 Drawing Sheet

ENCAPSULATED TONER FOR HEAT-AND-PRESSURE FIXING

BACKGROUND OF THE INVENTION

1. Field of the Invention

The present invention relates to an encapsulated toner for heat-and-pressure fixing used for development of electrostatic latent images in electrophotography, electrostatic printing, or electrostatic recording.

2. Discussion of the Related Art

As described in U.S. Pat. Nos. 2,297,691 and 2,357,809 and other publications, conventional electrophotography comprises the steps of forming an electrostatic latent image by evenly charging a photoconductive insulating layer, subsequently exposing the layer to eliminate the charge on the exposed portion and visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process).

As indicated above, the toner must meet the requirements not only of the development process, but also of the transfer process and the fixing process.

Generally, a toner undergoes mechanical frictional forces due to shear force and impact force during the mechanical operation in a developer device, and deteriorates after copying from several thousands to several ten thousands of sheets. The deterioration of the toner can be prevented by using a tough resin having such a high molecular weight that it can withstand the above mechanical frictional forces. However, this kind of a resin generally has such a high softening point that the resulting toner cannot be sufficiently fixed by a non-contact method, such as oven fixing and radiant fixing by infrared rays, because of its poor thermal efficiency. Further, when the toner is fixed by a contact fixing method, such as a heat-and-pressure fixing method using a heat roller, which is excellent in thermal efficiency and therefore widely used, it becomes necessary to raise the temperature of the heat roller in order to achieve sufficient fixing of the toner, which brings about such disadvantages as deterioration of the fixing device, curling of the paper, and increase in consumed energy. Furthermore, the resin described above is poor in grindability, thereby remarkably lowering the production efficiency of the toner. Accordingly, the binder resin having too high of a degree of polymerization and also too high of a softening point cannot be used.

Meanwhile, according to the heat-and-pressure fixing method using a heat roller, the thermal efficiency is excellent, so that this method is widely used in various high-speed and low-speed copy machines. However, when the surface of a heat roller contacts the surface of the visible image, the toner is likely to cause a so-called "offset phenomenon," wherein the toner is adhered to the surface of the heat roller, and thus transferred to a subsequent transfer paper. In order to prevent this phenomenon, the surface of a heat roller is coated with a material having excellent release properties for the toner such as fluororesins, and further a releasing agent such as a silicone oil is applied thereon. However, the method of applying a releasing agent is likely to bring about various problems such as high costs and device troubles.

Although processes for improving the offset phenomenon by unsymmetrizing or crosslinking the resins have been disclosed in Japanese Patent Examined Publication No. 57-493 and Japanese Patent Laid-Open Nos. 50-44836 and 57-37353, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature at which high-temperature offsetting occurs as much as possible, the serviceable fixing temperature can be lowered and the serviceable temperature range can be widened, which enables energy saving, high-speed fixing and prevention of curling of paper.

From the above reasons, the development of a toner having excellent fixing ability and offset resistance has always been desired.

Conventionally, various methods in which low-temperature fixing is achieved by using an encapsulated toner comprising a core material and a shell formed thereon so as to cover the surface of the core material have been proposed.

Among such toners, those having a core material made of a low-melting wax which is easily plastically deformable, as described in U.S. Pat. No. 3,269,626, Japanese Patent Examined Publication Nos. 46-15876 and 44-9880, and Japanese Patent Laid-Open Nos. 48-75032 and 48-75033, are poor in fixing strength, so that they can be used only in limited areas, although they can be fixed only by pressure. Further, in the case where toners having a liquid core material are used, when the shell strength is too low, the shell materials tend to break in the developer device and stain the inside thereof, though the toners are fixable with pressure alone. When the shell strength is too high, much pressure is necessary to break the capsule, and thereby the resulting formed images become too glossy. Thus, it has been difficult to control the strength of the shell materials.

Therefore, as a toner for heat-and-pressure fixing, an encapsulated toner for heat roller fixing has been proposed, which comprises a core material made of a resin having a low glass transition temperature which serves to improve the fixing strength, though blocking at a high temperature may take place if used alone, and a shell made of a high-melting point resin wall which is formed by interfacial polymerization for the purpose of imparting a blocking resistance to the toner. However, in Japanese Patent Laid-Open No. 61-56352, this toner cannot fully exhibit the performance of the core material, because the melting point of the shell material is too high and also the shell is too tough and not easily breakable. On the same line of the technical idea as that described above, encapsulated toners for heat roller fixing with an improved fixing strength of the core material have been proposed (see Japanese Patent Laid-Open Nos. 58-205162, 58-205163, 63-128357, 63-128358, 63-128359, 63-128360, 63-128361, and 63-128362). However, since these toners are prepared by a spray drying method, a higher load to the equipments for the production thereof becomes necessary. In addition, they cannot fully exhibit the performance of the core material, because they have not come up with a solution for the problems by the shell material.

Further, in the encapsulated toner proposed in Japanese Patent Laid-Open No. 63-281168, the shell is made of a thermotropic liquid crystal polyester, and in the encapsulated toner proposed in Japanese Patent Laid-Open No. 4-184358, a crystalline polyester is used. Since each of the polyesters used in these references is not amorphous, the resin sharply melts. However, the amount of energy required for fusion is large, and the Tg of the core material is also high, thereby making the fixing ability of the resulting toner poor.

As explained above, although encapsulated toners produced using various materials and production methods have been proposed, a toner satisfying all of the features such as low-temperature fixing ability, the offset resistance, the blocking resistance, and the stress resistance in a developer device has not yet been found. Particularly, no disclosure has yet been made to give quantitative evaluations of physical properties of the encapsulated toner which satisfy the above features.

SUMMARY OF THE INVENTION

An object of the present invention is to provide an encapsulated toner for heat-and-pressure fixing which has excellent offset resistance, is fixable even at a low temperature, and has excellent blocking resistance and excellent stress resistance in the developer device when the encapsulated toner is used for heat-and-pressure fixing using a heat roller.

As a result of intensive research in view of solving the above-mentioned problems, the present inventors have found that the encapsulated toner for heat-and-pressure fixing capable of stably forming clear visible images free from background for a large amount of copying, the toner having sufficient low-temperature fixing ability and excellent blocking resistance and not being smashed by stress in the developer device, can be provided when satisfying a relationship between a load and a compressive variation when applying the load to one encapsulated toner particle and adjusting the cohesion thereof. The present invention has been completed based upon this finding.

Specifically, the present invention is concerned with the following:

1. An encapsulated toner for heat-and-pressure fixing comprising a heat-fusible core material containing at least a thermoplastic resin and a coloring agent and a shell formed thereon so as to cover the surface of the core material, the encapsulated toner having the following properties:
   1) The glass transition temperature ascribed to the thermoplastic resin used as a main component of the heat-fusible core material is 10° C. to 50° C.;
   2) A minimum load required for 5% compression of a particle size of the encapsulated toner is from 5 to 50 mgf, and a minimum load required for 10% compression of a particle size of the encapsulated toner is from 10 to 100 mgf, when a compressive variation of one toner particle is measured by a micro compression testing machine under the following conditions:
      [1] the micro compression testing machine comprising a flat upper pressurizing element made of diamond having a diameter of 50 μm and a flat lower pressurizing element made of SKS (Special Steel),
      [2] a temperature of 25° C. and a humidity of 50%, and
      [3] a load applying speed of 9.1 mgf/sec, and
   3) The difference in cohesiveness before and after keeping the toner standing at 50° C. for 24 hours, is not more than 10, wherein the cohesiveness is defined as the sum of values (a), (b), and (c) obtained by the following equations:
      (a)=(weight % of the toner remaining×1, on a 250 μm mesh-sieve)
      (b)=(weight % of the toner remaining×0.6, and on a 149 μm mesh-sieve)
      (c)=(weight % of the toner remaining×0.2, on a 74 μm mesh-sieve)

wherein each of the weight % in the equations is measured by a powder property analyzer;
2. The encapsulated toner described in (1) above, wherein the softening point of the encapsulated toner is from 70° to 150° C.;
3. The encapsulated toner described in (1) or (2) above, wherein the surface of the core material is coated with a hydrophilic shell material comprising an amorphous polyester as a main component; and
4. The encapsulated toner described in (3) above, wherein the amorphous polyester is obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers, at least one of the monomers being a trihydric or higher polyhydric alcohol monomer or a tricarboxylic or higher polycarboxylic acid monomer.

In the encapsulated toner for heat-and-pressure fixing of the present invention, the toner has excellent offset resistance, is fixable at a low temperature, and has excellent blocking resistance and excellent stress resistance in the developer device. Therefore, clear images free from background can be stably formed for a large amount of copying in a heat-and-pressure fixing method using a heat roller.

BRIEF DESCRIPTION OF THE DRAWING

The present invention will become more fully understood from the detailed description given hereinbelow and the accompanying drawing which is given by way of illustration only, and thus, is not limitative of the present invention, and wherein.

DETAILED DESCRIPTION OF THE INVENTION

Figure 1:
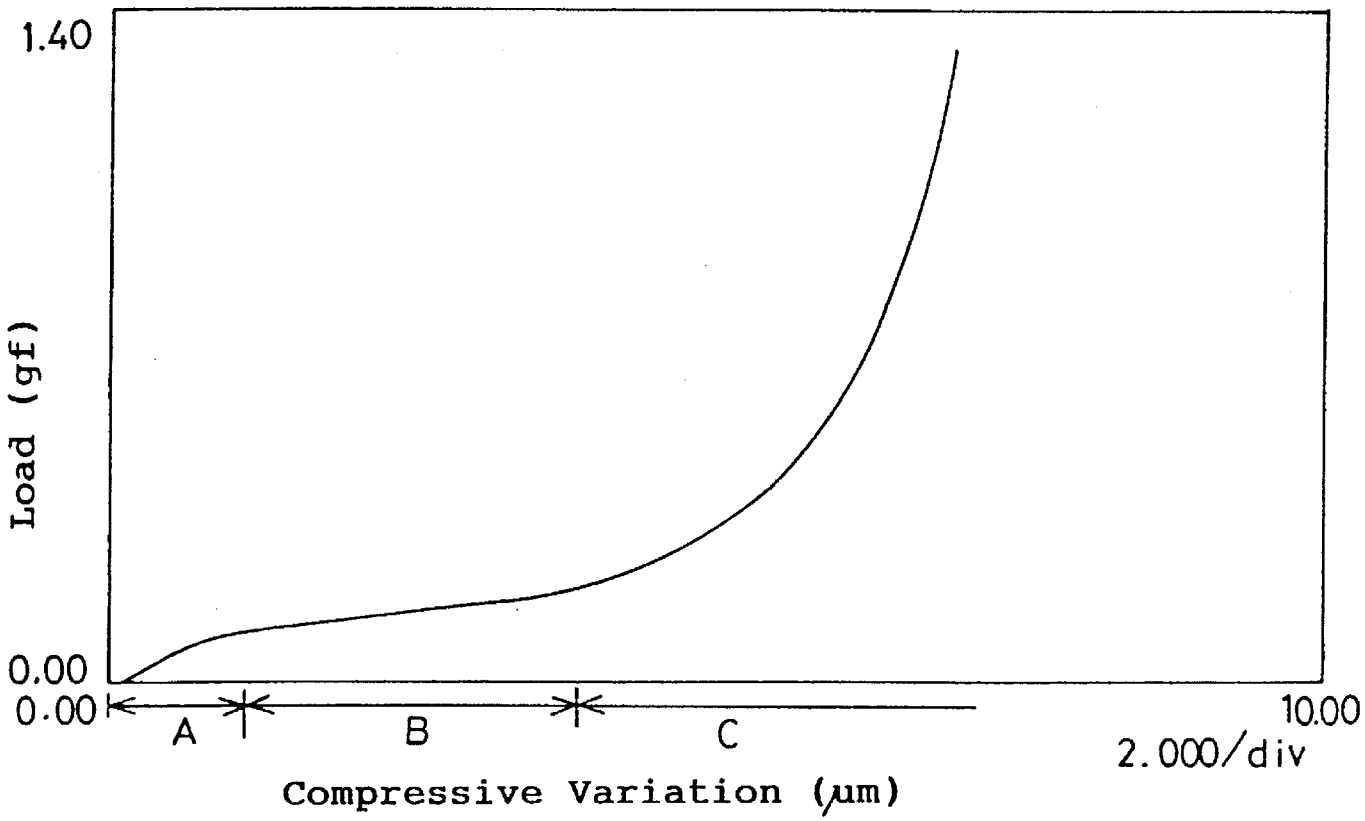
FIG. 1 is a graph schematically showing a typical relationship between a load and a compressive variation in the encapsulated toner of the present invention.

The encapsulated toner for heat-and-pressure fixing of the present invention has the following properties.

First, the glass transition temperature ascribed to the thermoplastic resin used as a main component of the heat-fusible core material of the encapsulated toner is from 10° to 50° C., preferably from 12.5° to 47.5° C., more preferably 15° to 45° C. When the glass transition temperature is less than 10° C., the storage stability of the resulting toner is likely to be poor, and when the glass transition temperature exceeds 50° C., the fixing strength of the resulting toner is likely to be poor.

Also, the encapsulated toner for heat-and-pressure fixing of the present invention has the following relationship between the load and the compressive variation of the toner particles. Specifically, the relationship between the load and the compressive variation can be measured by using, for instance, a micro compression testing machine MCTM-200 (manufactured by Shimadzu Corporation) when a load is applied to one toner particle at a temperature of 25° C. and a humidity of 50%. This testing machine comprises an upper pressurizing element and a lower pressurizing element, wherein the upper pressurizing element is a flat element made of diamond having a diameter of 50 μm, and the lower pressurizing element is a flat plate made of SKS (Special Steel). The testing conditions are as follows:

(1) Type of Test: Mode 3 (test for soft materials).

(2) Sample shape: Granular mode.

(3) Load applying speed constant: 10 (load applying speed of 9.1 mgf/sec).

The particle diameter is determined by measuring with a device (an optical microscope) attached to the testing machine and averaging the lengths taken in the longitudinal and lateral directions. The measurement of the compression is taken for each toner particle, and then repeated for not less than ten times. The value given herein is an average value for ten measurements. This average value of the compressive variation thus calculated is highly reproducible, reflecting properties inherent in each toner.

FIG. 1 is a graph showing a typical relationship between the load applied and the compressive variation obtained under the conditions described above. In the range "A" of the figure, a so-called kickoff portion, the compressive variation increases linearly with the load, and in the range "B," an inflection point appears where the compressive variation changes drastically at a given value of load. This means that the toner particle can no longer resist the load applied thereonto, so that a drastic deformation takes place. In the range "C," another inflection point appears, from which the compressive variation becomes very small even when a large load is applied, meaning that the toner particle is completely smashed by the load. Therefore, in order to improve the low-temperature fixing ability of the toner, a toner capable of being deformed and smashed even with a smaller load is highly desired. On the other hand, in order to endure stress caused by stirring in the developer device, particularly to endure the stress caused in the developer device, it is necessary to make the toner unsmashable even with a larger load.

As described above, the relationship between the load and the compressive variation, the low-temperature fixing ability, and the stress resistance in the developer device are further analyzed. As a result, it is found that toners satisfying the above features can be obtained when the minimum load required for 5% compression of the particle diameter is in the range from 5 to 50 mgf, preferably from 7.5 to 45 mgf, more preferably from 10 to 40 mgf, and when the minimum load required for 10% compression is in the range from 10 to 100 mgf, preferably from 15 to 90 mgf, more preferably from 20 to 80 mgf.

When the minimum load required for 5% compression of the particle diameter is less than 5 mgf or the minimum load required for 10% compression is less than 10 mgf, the cohesion of the toner particles and the melting of the toner onto the developer sleeve are likely to take place due to the stress caused in the developer device. Particularly in the case of the two-component development, the toner particles are likely to be adsorbed on the carrier, so that background and toner scattering are likely to take place. When the minimum load required for 5% compression of the particle diameter exceeds 50 mgf or the minimum load required for 10% compression exceeds 100 mgf, sufficient low-temperature fixing ability is not likely to be achieved Moreover, the encapsulated toner for heat-and-pressure fixing of the present invention has the following properties regarding the cohesiveness. Specifically, the difference in the cohesiveness before and after keeping the toner standing at 50° C. for 24 hours is not more than 10, wherein the cohesiveness is defined as the sum of values (a), (b), and (c) obtained by the following equations:

(a)=(the weight % of the toner remaining×1, on the 250 μm mesh-sieve)

(b)=(the weight % of the toner remaining×0.6, and on the 149 μm mesh-sieve)

(c)=(the weight % of the toner remaining×0.2, on the 74 μm mesh-sieve), wherein each of the weight % in the equations is measured by a powder property analyzer.

In the present invention, the cohesiveness is measured by, for instance, using POWDER TESTER (manufactured by Hosokawa Micron Co.), arranging three different mesh-size sieves such that a 250 μm-sieve is on top, a 149 μm-sieve is intermediary, and a 74 μm-sieve is at bottom, each sieve having a diameter of 70 mm, and vibrating the set of sieves with an amplitude of 1 mm for 1 minute.

The samples to be sieved are 2 g of toners weighed in an aluminum vessel which are kept standing at 50° C. for 24 hours in a dry oven or 2 g of toners without standing. Smaller the difference in the cohesiveness for toners before and after kept standing at 50° C. for 24 hours, higher the blocking resistance of the toner. In the encapsulated toner for heat-and-pressure fixing of the present invention, when the difference in the cohesiveness is not more than 10, there arises substantially no problems under normal environmental conditions. However, when taking into consideration a long-term storage stability at high temperature of the toner, the difference in the cohesiveness is preferably not more than 8, more preferably not more than 6.

The encapsulated toner for heat-and-pressure fixing of the present invention has a softening point of from 70° to 150° C., preferably from 75° C. to 145° C., more preferably from 80° to 140° C. When the softening point is lower than 70° C., the offset resistance of the toner is likely to be poor, and when it exceeds 150° C., the fixing ability of the toner is likely to be poor.

The core materials and the shell materials of the encapsulated toners for heat-and-pressure fixing of the present invention are not particularly limited as long as they meet the requirements in the above properties. The present invention will be further detailed by preferred examples given below.

An encapsulated toner for heat-and-fixing of the present invention preferably comprises a core material and a shell made of a hydrophilic material containing an amorphous polyester, etc. as a main component formed thereon so as to cover the core material.

The amorphous polyester can be usually obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers, at least one of the monomers being a trihydric or higher polyhydric alcohol monomer or a tricarboxylic or higher polycarboxylic acid monomer are suitably used.

The amorphous polyester described above can be contained in an amount of normally 50 to 100% by weight, based on the total weight of the shell, and the other components which may be contained in the shell include polyamides, polyester-amides, and polyurea resins in an amount of 0 to 50% by weight.

Examples of the dihydric alcohol monomers include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and other dihydric alcohol monomers.

Examples of the trihydric or higher polyhydric alcohol monomers include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-l,2,4-butanetriol, trimethylolethane, trimethylolpropane, 1,3,5-trihydroxymethylbenzene, and other trihydric or higher polyhydric alcohol monomers. Among the alcohol monomers, the trihydric alcohol monomers are preferably used.

In the present invention, these dihydric alcohol monomers and trihydric or higher polyhydric alcohol monomers may be used singly or in combination.

As for the acid components, examples of the dicarboxylic acid monomers include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, acid anhydrides thereof, lower alkyl esters thereof, and other dicarboxylic acid components.

Examples of the tricarboxylic or higher polycarboxylic acid monomers include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components. In the present invention, among these carboxylic acid components, a preference is given to the tricarboxylic acids and derivatives thereof.

In the present invention, these dicarboxylic acid monomers and tricarboxylic or higher polycarboxylic acid monomers may be used singly or in combination.

The method for producing an amorphous polyester in the present invention is not particularly limited, and the amorphous polyester can be produced by esterification or transesterification of the above monomers.

Here, "amorphous" refers to those which do not have a definite melting point. When a crystalline polyester is used in the present invention, the amount of energy required for fusion is large, and thereby the fixing ability of the toner becomes undesirably poor.

The glass transition temperature of the amorphous polyester thus obtained is preferably 50° to 80° C., more preferably 55° to 75° C. When the glass transition temperature is less than 50° C., the storage stability of the resulting toner becomes poor, and when it exceeds 80° C., the fixing ability of the resulting toner becomes undesirably poor. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC MODEL 210," manufactured by Seiko Instruments, Inc.), at a temperature rise rate of 10° C./min.

The acid value of the above amorphous polyester is preferably 3 to 50 KOH mg/g, more preferably 10 to 30 KOH mg/g. When the acid value is less than 3 KOH mg/g, the amorphous polyester used as the shell-forming material is less likely to be formed on the core material during the seed polymerization, thereby making the storage stability of the resulting toner poor, and when it exceeds 50 KOH mg/g, the polyester is likely to shift to a water phase, thereby making the production stability poor. Here, the acid value is measured by the method according to JIS K0070.

The encapsulated toner whose shell comprises an amorphous polyester suitably used in the present invention can be produced by such known methods as in situ polymerization method. This encapsulated toner comprises a heat-fusible core material comprising at least a thermoplastic resin and a coloring agent and a shell formed thereon so as to cover the surface of the core material.

The resins used as the main components of the heat-fusible core material in the encapsulated toner of the present invention include thermoplastic resins such as polyester resins, polyester-polyamide resins, polyamide resins, and vinyl resins, with a preference given to the vinyl resins. The glass transition temperatures ascribed to the thermoplastic resin used as the main component of the heat-fusible core material mentioned above are preferably from 10° C. to 50° C., more preferably 20° C. to 45° C. When the glass transition temperature is less than 10° C., the storage stability of the encapsulated toner becomes poor, and when it exceeds 50° C., the fixing strength of the encapsulated toner becomes undesirably poor.

Among the above-mentioned thermoplastic resins, examples of the monomers of the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene, and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids such as acrylonitrile, methacrylonitrile, and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin components in the present invention, it is preferred that styrene or styrene derivatives is used in an amount of 50 to 90% by weight to form the main structure of the resins, and that the ethylenic monocarboxylic acid or esters thereof is used in an amount of 10 to 50% by weight in order to adjust the thermal properties such as the softening point of the resins, because the glass transition temperature of the core material resin can be easily controlled.

A crosslinking agent may be added, if necessary, to the monomer composition. In such a case, any known crosslinking agents may be suitably used. Examples of crosslinking agents added to monomer compositions constituting the core material resins include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is 0.001 to 15% by weight, preferably 0.1 to 10% by weight, based on the polymerizable monomers. When the amount of these crosslinking agents used is more than 15% by weight, the resulting toner is less likely to be melted with heat, thereby resulting in poor heat fixing ability and poor heat-and-pressure fixing ability. On the contrary, when the amount used is less than 0.001% by weight, in the heat-and-pressure fixing, an offset phenomenon is likely to take place wherein a part of the toner cannot be completely fixed on a paper but rather adheres to the surface of a roller, which in turn is transferred to a subsequent paper.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the polymerizable monomers.

In the present invention, a coloring agent is contained in the core material of the encapsulated toner, and any of the conventional dyes or pigments, which are used for coloring agents for the toners may be used.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, and the mixtures thereof. The coloring agent is usually used in an amount of about 1 to 15 parts by weight based on 100 parts by weight of the resin contained in the core material.

In the present invention, a charge control agent may be further added to the core material. Negative charge control agents to be added are not particularly limited, and examples thereof include azo dyes containing metals such as "VARI-FAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), "T-77" (manufactured by Hodogaya Chemical Co., Ltd.), and "AIZEN SPILON BLACK TRH" (manufactured by Hodogaya Chemical Co., Ltd.); copper pthalocyanine dye; metal complexes of alkyl derivatives of salicylic acid such as "BONTRON E-81" (manufactured by Orient Chemical Co., Ltd.), "BONTRON E-82" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives, with a preference given to T-77 and AIZEN SPILON BLACK TRH.

The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives, with a preference given to BONTRON N-07 and AFP-B.

The above charge control agents may be contained in the core material in an amount of 0.1 to 8.0% by weight, preferably 0.2 to 5.0% by weight.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons, and silicone oils.

Examples of the above polyolefins include resins such as polypropylene, polyethylene, and polybutene, which have softening points of from 80° to 160° C. Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof. Examples of the above fatty acid esters include ethyl maleate, butyl maleate, methyl stearate, butyl stearate, cetyl palmitate, and ethylene glycol montanate. Examples of the above partially saponified fatty acid esters include montanic acid esters partially saponified with calcium. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide, and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference given to polypropylene.

It is preferable to use the offset inhibitors in a proportion of 1 to 20% by weight, based on the resin contained in the core material.

Next, the method for production of the encapsulated toner of the present invention will be explained in detail below. The toners of the present invention can be produced by any methods without limitation as long as an encapsulated toner having the above-mentioned properties for compressive variation and cohesiveness can be obtained. Among them, the encapsulated toners of the present invention are suitably produced by in situ polymerization method from the viewpoint of simplicity in the production facilities and the production steps.

In the method for producing an encapsulated toner for heat-and-pressure fixing of the present invention comprising a heat-fusible core material containing at least a thermoplastic resin and a coloring agent and a shell formed thereon so as to cover the surface of the core material, the method comprises the steps of:

(a) dissolving the shell-forming resin in a mixture comprising a core material-constituting monomer, a polymerization initiator, and a coloring agent;

(b) dispersing the mixture obtained in step (a) in an aqueous dispersant, and localizing the shell-forming resin on the surface of droplets of the core-constituting material to give a polymerizable composition; and (c) polymerizing the polymerizable composition obtained in step (b) by in situ polymerization to form the core material, the shell covering the surface of the core material.

In the method for production of the encapsulated toner, the shell can be formed by utilizing the property that when a mixed solution comprising the core-constituting materials and the shell-forming material comprising an amorphous polyester is dispersed in an aqueous dispersant, the shell-forming material localizes onto the surface of the oil droplets. Specifically, the separation of the core-constituting materials and the shell-forming material in the oil droplets of the mixed solution takes place due to the difference in the solubility indices, and the polymerization proceeds in this state to form core material resin and at the same time to form a shell, and thereby an encapsulated structure is formed. By this method, a shell is formed as a layer of the amorphous polyester with a substantially uniform thickness, so that the triboelectric chargeability of the toner becomes uniform.

When the encapsulated toner is produced by the above method, a dispersion stabilizer is added into the dispersion medium in order to prevent aggregation and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

Examples of the dispersion media include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the method for producing the encapsulated toner in the present invention, the amount of the above shell-forming resin as the main component is normally 3 to 50 parts by weight, preferably 5 to 40 parts by weight, more preferably 6 to 30 parts by weight, based on 100 parts by weight of the core material. When the amount of the shell-forming resin is less than 3 parts by weight, the resulting shell becomes too thin in its thickness, thereby making the storage stability of the toner poor. When it exceeds 50 parts by weight, the droplets dispersed in the aqueous dispersant have an undesirably high viscosity, thereby making it difficult to produce fine grains, which in turn results in poor production stability.

In present invention, the encapsulated toner produced by the method explained above may be used as precursor particles, and seed polymerization may be further conducted to give an encapsulated toner for heat-and-pressure fixing. Therefore, in the present invention, there are two preferred embodiments for the encapsulated toners of the present invention: One wherein the encapsulated toner is produced by in situ polymerization alone, and another wherein the encapsulated toner is produced by a combination of in situ polymerization and seed polymerization.

The seed polymerization in the present invention comprises the steps of adding at least a vinyl polymerizable monomer and an initiator for vinyl polymerization to an aqueous suspension of the encapsulated toner produced by the method explained above (hereinafter which may be simply referred to as "precursor particles") to absorb them into the precursor particles; and polymerizing the monomer components in the above precursor particles.

For instance, when the precursor particles are produced by in situ polymerization method described above, at least a vinyl polymerizable monomer and an initiator for vinyl polymerization are immediately added to the precursor particles in a suspending state, and the monomer and the initiator are absorbed into the precursor particles, so that seed polymerization takes place with the monomer components absorbed in the precursor particles. By this method, the production steps can be simplified. The vinyl polymerizable monomers, etc. which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain other additives such as a crosslinking agent, an offset inhibitor, and a charge control agent.

The vinyl polymerizable monomers used in the seed polymerization may be the same ones as those used for the production of the precursor particles. Also, the initiators for vinyl polymerization, the crosslinking agents and the dispersion stabilizers may also be the same ones as those used for the production of the precursor particles. The amount of the crosslinking agent used in the seed polymerization is preferably 0.001 to 15% by weight, more preferably 0.1 to 10% by weight, based on the vinyl polymerizable monomers. When the amount of these crosslinking agents used is more than 15% by weight, the resulting toner is less likely to be melted with heat, thereby resulting in poor heat fixing ability and poor heat-and-pressure fixing ability. On the contrary, when the amount used is less than 0.001% by weight, in the heat-and-pressure fixing, an offset phenomenon is likely to take place wherein a part of the toner cannot be completely fixed on a paper but rather adheres to the surface of a roller, which in turn is transferred to a subsequent paper.

In order to further improve the storage stability of the toner, hydrophilic shell-forming materials such as the amorphous polyester described above may be added to the aqueous emulsion. In this case, the amount of the shell-forming material added is normally 1 to 20 parts by weight, preferably 3 to 15 parts by weight, based on 100 parts by weight of the core material. Here, other examples of the hydrophilic shell materials than the amorphous polyesters including vinyl resins having hydrophilic functional groups, such as a carboxyl group, an acid anhydride group, a hydroxyl group, an amino group, and an ammonium ion, amorphous polyesteramide resins, amorphous polyamide resins, and epoxy resins may be also used. The aqueous emulsion described above can be prepared by uniformly dispersing the mixture using such devices as an ultrasonic vibrator.

The acid value of the amorphous polyester used in the seed polymerization, as in the case of that used in in situ polymerization reaction, is preferably 3 to 50 KOH mg/g, more preferably 10 to 30 KOH mg/g. When it is less than 3 KOH mg/g, the amorphous polyester used as the shell-forming material is less likely to be formed on the core material during the seed polymerization, thereby making the storage stability of the resulting toner poor, and when it exceeds 50 KOH mg/g, the polyester is likely to shift to a water phase, thereby making the production stability poor. Here, the acid value is measured by the method according to JIS K0070.

The amount of the aqueous emulsion added is adjusted so that the amount of the vinyl polymerizable monomer used is 10 to 200 parts by weight, based on 100 parts by weight of the precursor particles. When the vinyl polymerizable monomer is less than 10 parts by weight, sufficient effects for improving the fixing ability of the resulting toner cannot be achieved, and when it exceeds 200 parts by weight, it would be difficult to uniformly absorb the monomer components in the precursor particles.

By adding the aqueous emulsion thereto, the vinyl polymerizable monomer is absorbed into the precursor particles so that the swelling of the precursor particles takes place. In the seed polymerization reaction, the monomer components in the precursor particles are polymerized in the above state. This polymerization may be referred to as "seed polymerization," wherein the precursor particles are used as seed particles.

As explained above, the following features are improved when compared with the case where the encapsulated toner is produced solely by in situ polymerization method.

Specifically, the encapsulated toner produced by in situ polymerization method has more excellent low-temperature fixing ability and storage stability than conventional toners, and by further carrying out the seed polymerization method, a shell is formed more uniformly by the principle of surface science, thereby achieving a further excellent storage stability. Also, since the polymerizable monomer in the core material can be polymerized in two steps, namely, in situ polymerization reaction and the seed polymerization reaction, the molecular weight of the thermoplastic resin in the core material can be easily controlled by using a suitable amount of the crosslinking agent, thereby making the low-temperature fixing ability and the offset resistance more excellent. In particular, a toner suitable not only for a high-speed fixing but also for a low-speed fixing can be produced.

In addition, for the purpose of charge control, the charge control agents exemplified above may be properly added to the shell-forming materials of the encapsulated toner of the present invention. Alternatively, the charge control agent may be used in a mixture with a toner. Since the shell itself controls chargeability, the amount of these charge control agents, if needed, can be minimized.

Although the particle diameter of the encapsulated toner produced by the method described above is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si-O-Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purpose of reducing electric resistance on the surface of the toner, a small amount of carbon black may be used. The carbon blacks may be those of conventionally known, including various kinds such as furnace black, channel black, and acetylene black.

When the encapsulated toner of the present invention contains particulate magnetic materials, it can be used alone as a developer, while when the encapsulated toner does not contain any particulate magnetic material, a non-magnetic one-component developer or a two-component developer can be prepared by mixing the toner with a carrier. Although the carrier is not particularly limitative, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle diameter of the carrier is 15 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are applied. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

EXAMPLES

The present invention is hereinafter described in more detail by means of the following working examples, comparative examples, and test examples, but the present invention is not limited by these examples.

Resin Production Example 367.5 g of a propylene oxide adduct of bisphenol A, 146.4 g of an ethylene oxide adduct of bisphenol A, 126.0 g of terephthalic acid, 40.2 g of dodecenylsuccinic anhydride, and 77.7 g of trimellitic anhydride are placed in a two-liter four-necked glass flask equipped with a thermometer, a stainless steel stirring rod, a reflux condenser, and a nitrogen inlet tube, and the components are allowed to react with one another at 220° C. in a mantle heater under a nitrogen gas stream while stirring.

The degree of polymerization is monitored from a softening point measured according to ASTM E 28-67, and the reaction is terminated when the softening point reaches 110° C. The obtained resin is referred to as "Resin A."

Also, the glass transition temperature of the obtained resin is measured by the differential scanning calorimeter ("DSC Model 220," manufactured by Seiko Instruments, Inc.). As a result, it is 65° C. Also, the softening point and the acid value are measured, and the respective values are 110° C. and 18 KOH mg/g. The acid value is measured by the method according to JIS K0070.

Here, the "softening point" used herein refers to the temperature corresponding to one-half of the height (h) of the S-shaped curve showing the relationship between the downward movement of a plunger (flow length) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

Example 1

20.0 parts by weight of Resin A and 3.5 parts by weight of 2,2'-azobisisobutyronitrile are added to a mixture comprising 65.0 parts by weight of styrene, 35.0 parts by weight of 2-ethylhexyl acrylate, 0.9 parts by weight of divinylbenzene, 7.0 parts by weight of carbon black "#44" (manufactured by Mitsubishi Kasei Corporation), and 1.0 part by weight of charge control agent "T-77" (Hodogaya Chemical Co., Ltd.). The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at a temperature of 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are allowed to react with one another at 85° C. for 10 hours in a nitrogen atmosphere while stirring. After the reaction product is cooled, the dispersing agent is dissolved in 440 ml of 1 N-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 1." The glass transition temperature ascribed to the resin contained in the core material is 28.5° C., and the softening point of Toner 1 is 118.3° C.

Example 2

15.0 parts by weight of Resin A, 7.0 parts by weight of carbon black "#44" (manufactured by Mitsubishi Kasei Corporation), and 1.0 part by weight of charge control agent "T-77" (Hodogaya Chemical Co., Ltd.) are added to a mixture comprising 65.0 parts by weight of styrene, 35.0 parts by weight of 2-ethylhexyl acrylate, and 6.0 parts by weight of 2,2'-azobisisobutyronitrile. The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at room temperature and a rotational speed of 10000 rpm for 2 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are allowed to react with one another at 85° C. for 10 hours in a nitrogen atmosphere while stirring to give seed particles. The seed particles are cooled to room temperature to give precursor particles.

Next, 40.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 0.1 parts by weight of sodium laurylsulfate, 1.0 part by weight of charge control agent "T-77," and 20 parts by weight of water is added dropwise to an aqueous suspension containing the above precursor particles, the emulsion being prepared by a ultrasonic vibrator ("US-150," manufactured by Nippon Seiki Co., Ltd.), so that the precursor particles are swelled thereby. Immediately after the dropwise addition, when the emulsion is observed using an optical microscope, no emulsified droplets are found, confirming that swelling has finished in a remarkably short period of time. Thereafter, as a second-step polymerization, the contents are allowed to react with one another at 85° C. for 10 hours in a nitrogen atmosphere while stirring. After the reaction product is cooled, the dispersing agent is dissolved in 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 2." The glass transition temperature ascribed to the resin contained in the core material is 25.4° C., and the softening point of Toner 2 is 105.6° C.

Example 3

15.0 parts by weight of Resin A is added to a mixture comprising 65.0 parts by weight of styrene, 35.0 parts by weight of 2-ethylhexyl acrylate, 6.0 parts by weight of 2,2'-azobisisobutyronitrile, and 0.8 parts by weight of divinylbenzene, and Resin A is dissolved in the mixture. After Resin A is completely dissolved, 20.0 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo).

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are allowed to react with one another at 85° C. for 10 hours in a nitrogen atmosphere while stirring to give seed particles. The seed particles are cooled to room temperature to give precursor particles.

Next, 122.6 parts by weight of an aqueous emulsion comprising 26.0 parts by weight of styrene, 14.0 parts by weight of 2-ethylhexyl acrylate, 1.6 parts by weight of 2,2'-azobisisobutyronitrile, 0.8 parts by weight of divinylbenzene, 0.2 parts by weight of sodium laurylsulfate, 1.0 part by weight of charge control agent "T-77," and 80.0 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are allowed to react with one another at 85° C. for 10 hours in a nitrogen atmosphere while stirring. After the reaction product is cooled, the dispersing agent is dissolved in 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 3." The glass transition temperature ascribed to the resin contained in the core material is 31.6° C., and the softening point of Toner 3 is 117.0° C.

Example 4

15.0 parts by weight of Resin A is added to a mixture comprising 65.0 parts by weight of styrene, 35.0 parts by weight of 2-ethylhexyl acrylate, 6.0 parts by weight of 2,2'-azobisisobutyronitrile, 0.8 parts by weight of divinylbenzene, and 1.0 part by weight of charge control agent "T-77," and Resin A is dissolved in the mixture. After Resin A is completely dissolved, 20.0 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo).

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are allowed to react with one another at 85° C. for 10 hours in a nitrogen atmosphere while stirring to give seed particles. The seed particles are cooled to room temperature to give precursor particles.

Next, 123.4 parts by weight of an aqueous emulsion comprising 26.0 parts by weight of styrene, 14.0 parts by weight of 2-ethylhexyl acrylate, 2.4 parts by weight of 2,2'-azobisisobutyronitrile, 0.8 parts by weight of divinylbenzene, 0.2 parts by weight of sodium laurylsulfate, 1.0 part by weight of charge control agent "T-77," and 80.0 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are allowed to react with one another at 85° C. for 10 hours in a nitrogen atmosphere while stirring. After the reaction product is cooled, the dispersing agent is dissolved in 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 4." The glass transition temperature ascribed to the resin contained in the core material is 32.0° C., and the softening point of Toner 4 is 115.2° C.

Comparative Example 1

70.0 parts by weight of styrene, 30.0 parts by weight of 2-ethylhexyl acrylate, 1.0 part by weight of divinylbenzene, 10.0 parts by weight of carbon black "#44" (manufactured by Mitsubishi Kasei Corporation), 4.0 parts by weight of 2,2'-azobisisobutyronitrile, and 9.5 parts by weight of 4,4'-diphenylmethane diisocyanate "MILLIONATE MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition.

This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes.

Next, a four-necked glass cap is set on the flask, and a reflux condenser, a thermometer, a dropping funnel fitted with a nitrogen inlet tube, and a stainless steel stirring rod are attached thereto. The flask is placed on an electric mantle heater. A solution of 22.0 g of resorcinol, 3.6 g of diethyl malonate, and 0.5 g of 1,4-diazabicyclo[2.2.2]octane in 40.0 g of ion-exchanged water is prepared, and the resulting mixture is added dropwise into the flask in a period of 30 minutes through the dropping funnel while stirring. Thereafter, the contents are allowed to react at 80° C. for 10 hours in a nitrogen atmosphere while stirring. After the reaction mixture is cooled, the dispersing agent is dissolved in 650 ml of 1 N-aqueous hydrochloric acid. The resulting mixture is filtered, and the obtained solid is washed with water, dried under a reduced pressure of 20 mmHg at 45° C. for 12 hours and classified with an air classifier to give the encapsulated toner with an average particle size of 9 μm whose shell is made of a resin having a thermally dissociating urethane bond. This toner is referred to as "Comparative Toner 1." The glass transition temperature ascribed to the resin contained in the core material is 30.2° C., and the softening point of Comparative Toner 1 is 130.0° C.

Comparative Example 2

20.0 parts by weight of Resin A and 3.5 parts by weight of 2,2'-azobisisobutyronitrile are added to a mixture comprising 69.0 parts by weight of styrene, 31.0 parts by weight of 2-ethylhexyl acrylate, 0.9 parts by weight of divinylbenzene, and 7.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at a temperature of 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are allowed to react with one another at 85° C. for 10 hours in a nitrogen atmosphere while stirring. After the reaction product is cooled, the dispersing agent is dissolved in 10% by weight-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner. This toner is referred to as "Comparative Toner 2." The glass transition temperature ascribed to the resin contained in the core material is 30.6° C., and the softening point of Comparative Toner 2 is 125.5° C.

Comparative Example 3

20.0 parts by weight of Resin A and 3.5 parts by weight of 2,2'-azobisisobutyronitrile are added to a mixture comprising 56.0 parts by weight of styrene, 44.0 parts by weight of 2-ethylhexyl acrylate, 0.9 parts by weight of divinylbenzene, and 7.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10°

C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at a temperature of 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are allowed to react with one another at 85° C. for 10 hours in a nitrogen atmosphere while stirring. After the reaction product is cooled, the dispersing agent is dissolved in 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner. This toner is referred to as "Comparative Toner 3." The glass transition temperature ascribed to the resin contained in the core material is 20.4° C., and the softening point of Comparative Toner 3 is 101.5° C.

Comparative Example 4

15.0 parts by weight of Resin A and 7.0 parts by weight of carbon black "#44" (manufactured by Mitsubishi Kasei Corporation) are added to a mixture comprising 69.0 parts by weight of styrene, 31.0 parts by weight of 2-ethylhexyl acrylate and 6.0 parts by weight of 2,2'-azobisisobutyronitrile. The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at room temperature and a rotational speed of 10000 rpm for 2 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 40.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 0.1 parts by weight of sodium laurylsulfate and 20 parts by weight of water is added dropwise to an aqueous suspension containing the above precursor particles, the emulsion being prepared by a ultrasonic vibrator ("US-150," manufactured by Nippon Seiki Co., Ltd.), so that the precursor particles are swelled thereby. Immediately after the dropwise addition, when the emulsion is observed using an optical microscope, no emulsified droplets are found, confirming that swelling has finished in a remarkably short period of time. Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Comparative Toner 4."

The glass transition temperature ascribed to the resin contained in the core material is 27.4° C., and the softening point of Comparative Toner 4 is 108.2° C.

Test Example

Each of the developers is prepared by placing 6 parts by weight of each of the toners and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes. The obtained developers are evaluated with respect to the triboelectric charge and the printing durability, the fixing ability, the compressive variation, and the cohesiveness according to the following methods. Incidentally, the glass transition temperatures and the softening points of these toners are shown in Table 1.

TABLE 1

| | Shell Material | Glass Transition Temperature (°C.) | Softening Point (°C.) |
|---|---|---|---|
| Example | | | |
| 1 | Amorphous Polyester | 28.5 | 118.3 |
| 2 | Amorphous Polyester | 25.4 | 105.6 |
| 3 | Amorphous Polyester | 31.6 | 117.0 |
| 4 | Amorphous Polyester | 32.0 | 115.2 |
| Comparative Example | | | |
| 1 | Thermally Dissociating Urethane | 30.2 | 130.0 |
| 2 | Amorphous Polyester | 30.6 | 125.5 |
| 3 | Amorphous Polyester | 20.4 | 101.5 |
| 4 | Amorphous Polyester | 27.4 | 108.2 |

(1) Triboelectric charge and printing durability

The triboelectric charge is measured by a blow-off type electric charge measuring device as described below. Specifically, a specific charge measuring device equipped with a Faraday cage, a capacitor and an electrometer is used. First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the triboelectric charge Q/m of this toner can be calculated by the following equation:

$$Q/m(\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m(g)=W\times(T/D)$$

The measurement results of the triboelectric charge of the developer prepared under normal conditions are shown in Table 2.

Also, the printing durability is evaluated as follows: Specifically, a commercially available copy machine is used to conduct continuous printing durability test for 10,000 sheets to evaluate the image quality of the formed images (background and generation of black spots). The copy machine is equipped with a selene-arsenic photoconductor and a fixing roller having a rotational speed of 255 mm/sec for Toners 1 and 2 and Comparative Toners 2, 3, and 4; equipped with a selene-arsenic photoconductor and a fixing roller having a rotational speed of 80 mm/sec for Toners 3 and 4; or equipped with an organic photoconductor and a fixing roller having a rotational speed of 255 mm/sec for Comparative Toner 1. The results are shown in Table 2.

TABLE 2

| | Triboelectric Charge (μC/g) | Fixing Condition | Printing Durability |
|---|---|---|---|
| Example | | | |
| 1 | −22 | 255 mm/sec | Good |
| 2 | −28 | 255 mm/sec | Good |
| 3 | −29 | 80 mm/sec | Good |
| 4 | −29 | 80 mm/sec | Good |
| Comparative Example | | | |
| 1 | +20 | 255 mm/sec | Good |
| 2 | −25 | 255 mm/sec | Good |
| 3 | −20 | 255 mm/sec | Adhesion after Copying 2000 Sheets |
| 4 | −28 | 255 mm/sec | Good |

(2) Fixing ability

The fixing ability is evaluated by the method as described below. Specifically, each of the developers prepared as described above is loaded on a commercially available electrophotographic copy machine to develop images. The copy machine is equipped with a selene-arsenic photoconductor and a fixing roller having a rotational speed of 255 mm/sec for Toners 1 and 2 and Comparative Toners 2, 3, and 4; equipped with a selene-arsenic photoconductor and a fixing roller having a rotational speed of 80 mm/sec for Toners 3 and 4; or equipped with an organic photoconductor and a fixing roller having a rotational speed of 255 mm/sec for Comparative Toner 1. Further, the copy machine is equipped with a fixing device with variable heat-and-pressure and temperature, and an oil applying device being removed from the copy machine. By controlling the fixing temperature from 70° C. to 220° C., the fixing ability and the offset resistance of the formed images are evaluated. The results are shown in Table 3.

The lowest fixing temperature used herein is the temperature of the fixing roller at which the fixing ratio of the toner exceeds 70%. This fixing ratio of the toner is determined by placing a load of 500 g on a sand-containing rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from this density value and a density value before the eraser treatment using the following equation.

$$\text{Fixing ratio} = \frac{\text{Image density after eraser treatment}}{\text{Image density before eraser treatment}}$$

The offset resistance is evaluated by measuring the temperature of the low-temperature offset disappearance and the temperature of the high-temperature offset initiation. Specifically, copying tests are carried out by raising the temperature of the heat roller surface at an increment of 5° C. in the range from 70° C. to 240° C., and at each temperature, the adhesion of the toner onto the heat roller surface for fixing is evaluated with naked eyes.

(3) Compressive variation

The compressive variation of each toner is measured by the following method:

Specifically, the compression variation is measured by using a micro compression testing machine MCTM-200 (manufactured by Shimadzu Corporation) at a temperature of 25° C. and humidity of 50%. This testing machine comprises an upper pressurizing element and a lower pressurizing element, wherein the upper pressurizing element is a flat element made of diamond having a diameter of 50 μm, and the lower pressurizing element is a flat plate made of SKS (Special Steel). The testing conditions are as follows:

(1) Type of Test: Mode 3 (test for soft materials).

(2) Sample shape: Granular mode.

(3) Load applying speed constant: 10 (load applying speed of 9.1 mgf/sec).

The particle diameter is determined by measuring with a device (an optical microscope) attached to the testing machine and averaging the lengths taken in the longitudinal and lateral directions. The measurement of the compression is taken for each toner particle, and then repeated for not less than ten times. The value given herein is an average value for ten measurements. This average value of the compressive variation thus calculated is highly reproducible, reflecting properties inherent in each toner. In the case where the values of the load required exactly for 5% compression or 10% compression of the particle size is not available, the values of the load required for the vicinity of 5% compression or 10% compression are approximately used and averaged. The results are shown in Table 3.

TABLE 3

| | Lowest Fixing Temp. (°C.) | Non-Offset Region (°C.) | Load Required for 5% Compression (mgf) | Load Required for 10% Compression (mgf) |
|---|---|---|---|---|
| Example | | | | |
| 1 | 108 | 90–220 | 28 | 52 |
| 2 | 100 | 90–220 | 15 | 29 |
| 3 | 87 | 70–240 | 22 | 41 |

TABLE 3-continued

| | Lowest Fixing Temp. (°C.) | Non-Offset Region (°C.) | Load Required for 5% Compression (mgf) | Load Required for 10% Compression (mgf) |
|---|---|---|---|---|
| 4 | 84 | 70–240 | 20 | 39.5 |
| Comparative Example | | | | |
| 1 | 115 | 100–220 | 61 | 115 |
| 2 | 122 | 100–220 | 58 | 112 |
| 3 | 95 | 90–220 | 3.5 | 6.9 |
| 4 | 105 | 100–220 | 23 | 48 |

(4) Cohesiveness and Long-Term Storage Stability

The cohesiveness is evaluated by the following method. Specifically, 2 g of toner is accurately weighed and placed into an aluminum container, and the container is placed in a dry oven and kept standing at 50° C. for 24 hours. The toner samples before and after the above treatment are subject to testing by arranging three different mesh-size sieves such that a 250 μm-sieve is on top, a 149 μm-sieve is intermediary, and a 74 μm-sieve is at bottom, each sieve having a diameter of 70 mm, and vibrating the set of sieves with an amplitude of 1 mm for 1 minute. The toner aggregation is defined as sum the values (a), (b), and (c) obtained by the following equations:

(a)=(the weight % of the toner remaining×1, on a 250 μm mesh-sieve)

(b)=(the weight % of the toner remaining×0.6, on a 149 μm mesh-sieve)

and (c)=(the weight % of the toner remaining×0.2, on a 74 μm mesh-sieve)

wherein each of the weight % in the equations is measured by using "POWDER TESTER" (manufactured by Hosokawa Micron Co.). The results are shown in Table 4.

Also, the long-term storage stability is evaluated by weighing out 200 g of toner in an aluminum container, placing the toner in a dry oven at 45° C., and keeping the toner standing in the dry oven for two weeks, one month, or two months, and carrying out a printing test using the toner after keeping in the same manner as the printing durability test. The extent of cohesiveness is evaluated as the long-term storage stability. The results are also shown in Table 4. In Table 4, "poor" means that black spots caused by cohesion are generated.

As is clear from Tables 3 and 4, with respect to Toners 1 through 4 according to the present invention, since the values of the loads required for 5% compression and for 10% compression of the particle diameter and those of the difference in the cohesiveness are in the appropriate ranges, the fixing ability, and the blocking resistance are excellent, so that even after the durability printing of 10,000 sheets, the resulting formed images have excellent image quality, free from generation of black spots and background due to stress generated in the developer device. On the other hand, in Comparative Examples 1 and 2, since the loads required for 5% compression or 10% compression of the particle diameter are large, their fixing ability is notably poorer than that of Examples 1 to 4, though the toners in Comparative Examples 1 and 2 are free from generation of black spots and background due to stress generated in the developer device. Moreover, in Comparative Example 3, the fixing ability is good because the load required for 5% compression or 10% compression of the particle diameter is small; however, black spots presumably ascribed to cohesiveness of toners and background are generated. Further, in Comparative Example 4, the fixing ability is good because the load required for 5% compression or 10% compression of the particle diameter is in the appropriate ranges. However, a large difference in cohesiveness of this toner gives poor long-term storage stability. By contrast, a small difference in cohesiveness in the toners in Examples 1 through 4 gives remarkably excellent long-term storage stability.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An encapsulated toner for heat-and-pressure fixing comprising a heat-fusible core material containing at least a thermoplastic resin and a coloring agent and a shell formed thereon so as to cover the surface of the core material, the encapsulated toner having the following properties:

1) The glass transition temperature ascribed to the thermoplastic resin used as a main component of the heat-fusible core material is 10° C. to 50° C.;

2) A minimum load required for 5% compression of a particle size of the encapsulated toner is from 5 to 50 mgf, and a minimum load required for 10% compression of a particle size of the encapsulated toner is from 10 to 100 mgf, when a compressive variation of one toner particle is measured by a micro compression testing machine under the following conditions:

TABLE 4

| | Cohesiveness After Standing | Cohesiveness Before Standing | Difference in Cohesiveness | Long-Term Storage Stability 2 wks. | 1 mon. | 2 mon. |
|---|---|---|---|---|---|---|
| Example | | | | | | |
| 1 | 7.6 | 2.1 | 5.5 | Good | Good | Good |
| 2 | 6.4 | 2.3 | 4.1 | Good | Good | Good |
| 3 | 4.2 | 1.9 | 2.3 | Good | Good | Good |
| 4 | 4.1 | 2.0 | 2.1 | Good | Good | Good |
| Comparative Example | | | | | | |
| 1 | 11.6 | 2.5 | 9.1 | Good | Good | Poor |
| 2 | 10.4 | 2.2 | 8.2 | Good | Good | Poor |
| 3 | 11.4 | 2.5 | 8.9 | Good | Good | Poor |
| 4 | 12.8 | 2.2 | 10.6 | Good | Poor | Poor |

[1] the micro compression testing machine comprising a flat upper pressurizing element made of diamond having a diameter of 50 μm and a flat lower pressurizing element made of SKS (Special Steel),

[2] a temperature of 25° C. and a humidity of 50%, and

[3] a load applying speed of 9.1 mgf/sec, and

3) The difference in cohesiveness before and after keeping the toner standing at 50° C. for 24 hours, is not more than 10, wherein the cohesiveness is defined as the sum of values (a), (b), and (c) obtained by the following equations:

(a)=(weight % of the toner remaining×1, on a 250 μm mesh-sieve)

(b)=(weight % of the toner remaining×0.6, and on a 149 μm mesh-sieve)

(c) =(weight % of the toner remaining×0.2, on a 74 μm mesh-sieve)

wherein each of the weight % in the equations is measured by a powder property analyzer.

2. The encapsulated toner according to claim 1, wherein the difference in cohesiveness is not more than 8.

3. The encapsulated toner according to claim 1, wherein the softening point of the encapsulated toner is from 70° to 150° C.

4. The encapsulated toner according to claim 1, wherein the surface of the core material is coated with a hydrophilic shell material comprising an amorphous polyester as a main component.

5. The encapsulated toner according to claim 4, wherein the amorphous polyester is obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers, at least one of the monomers being a trihydric or higher polyhydric alcohol monomer or a tricarboxylic or higher polycarboxylic acid monomer.

6. The encapsulated toner according to claim 1, wherein said minimum load required for 5% compression is from 7.5 to 45 mfg and said minimum load required for 10% compression is from 15 to 90 mfg.

7. The encapsulated toner according to claim 6, wherein said minimum load required for 5% compression is from 10 to 40 mfg and said minimum load required for 10% compression is from 20 to 80 mfg.

8. The encapsulated toner according to claim 2, wherein the difference in cohesiveness is not more than 6.

9. The encapsulated toner according to claim 7, wherein the difference in cohesiveness is not more than 6.

10. The encapsulated toner according to claim 3, wherein the softening point of the encapsulated toner is from 75° C. to 145° C.

11. The encapsulated toner according to claim 10, wherein the softening point of the encapsulated toner is from 80° C. to 140° C.

12. The encapsulated toner according to claim 9, wherein the softening point of the encapsulated toner is from 80° C. to 140° C.

13. The encapsulated toner according to claim 4, wherein said hydrophilic shell material further comprises polyamides, polyesteramides, polyureas, or combinations thereof in an amount of up to 50% by weight.

14. The encapsulated toner according to claim 4, wherein said amorphous polyester is contained in said hydrophilic shell material in an amount of from 50% to 100% by weight.

15. The encapsulated toner according to claim 1, wherein said thermoplastic resin is selected from the group consisting of polyester resins, polyester-polyamide resins, polyamide resins, and vinyl resins.

16. The encapsulated toner according to claim 15, wherein said thermoplastic resin has a glass transition temperature of from 20° C. to 45° C.

17. The encapsulated toner according to claim 16, wherein said thermoplastic resin is a vinyl resin.

* * * * *